US007537206B2

(12) United States Patent
Tokuno

(10) Patent No.: US 7,537,206 B2
(45) Date of Patent: May 26, 2009

(54) SHEET ALIGNMENT APPARATUS AND SHEET POST-PROCESSING APPARATUS

(75) Inventor: Yoshiaki Tokuno, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 324 days.

(21) Appl. No.: 11/226,354

(22) Filed: Sep. 15, 2005

(65) Prior Publication Data

US 2007/0065202 A1 Mar. 22, 2007

(51) Int. Cl.
*B65H 37/04* (2006.01)

(52) U.S. Cl. ..... 270/58.12; 270/58.07; 270/58.08; 270/58.09; 270/58.11

(58) Field of Classification Search ..... 270/58.07, 270/58.08, 58.09, 58.11, 58.12
See application file for complete search history.

(56) References Cited

U.S. PATENT DOCUMENTS 4,627,709 A * 12/1986 Kitajima et al. ..... 399/374
6,145,825 A 11/2000 Kunihiro et al.
6,382,614 B1 * 5/2002 Fukatsu et al. ..... 270/58.11
6,412,774 B1 * 7/2002 Saito et al. ..... 271/220
6,634,641 B2 * 10/2003 Yamakawa et al. ..... 271/220
2006/0214343 A1 * 9/2006 Terao et al. ..... 270/58.08

FOREIGN PATENT DOCUMENTS

JP 03192065 A * 8/1991
JP 09-216764 A 8/1997
JP 11-130338 A 5/1999
JP 2000-351522 A 12/2000

* cited by examiner

*Primary Examiner*—Gene Crawford
*Assistant Examiner*—Leslie A Nicholson, III
(74) *Attorney, Agent, or Firm*—Foley & Lardner LLP

(57) ABSTRACT

A sheet alignment apparatus includes a feeding section, stopper, stacking tray, support portion, and first and second press portions. The first press portion presses the portion in the vicinity of the downstream side edge of a sheet bundle composed of the sheets that have been stacked on the stacking tray to a level higher than a first predetermined height against the support portion. The second press portion presses the portion in the vicinity of the downstream side edge of a sheet bundle composed of the sheets that have been stacked on the stacking tray to a level higher than a second predetermined height that is higher than the first predetermined height against the support portion.

18 Claims, 9 Drawing Sheets

SHEET ALIGNMENT APPARATUS AND SHEET POST-PROCESSING APPARATUS

BACKGROUND OF THE INVENTION

1. Field of the Invention

The present invention relates to a sheet alignment apparatus and a sheet post-processing apparatus provided with the sheet alignment apparatus.

2. Description of the Related Art

In a sheet post-processing apparatus that performs so-called post-processing such as stapling or punching for a sheet bundle composed of collected sheets on which images are formed, a sheet alignment apparatus is used to align the edge of the sheet bundle at a predetermined alignment position before the post-processing.

FIG. 11 is a vertical cross-sectional view showing a configuration around a sheet alignment apparatus in a conventional sheet post-processing apparatus.

In the conventional sheet alignment apparatus shown in FIG. 11, a sheet S to be aligned is passed through a predetermined feeding path and guided to a stacking tray 4 by a feeding roller 303. As shown in FIG. 11, the stacking surface of the stacking tray 4 is sloped down to a stopper portion 21 and, accordingly, the sheet S on the stacking surface slips down by its own weight to the stopper portion 21.

A knurled belt 302 and a sheet discharge roller E feed the sheet S thus slipping down to the stopper portion 21 to allow it to be butted against a stopper 211 of the stopper portion 21. Thus, the downstream edge of the sheet in the feeding direction thereof stops at a predetermined alignment position (butting surface of the stopper 211).

The sheets are thus sequentially butted against the stopper 211 and sequentially stacked on the stacking tray 4. Meanwhile, each of the sheets onto which a toner image has been heat-fixed may be curled in some case. Therefore, in order to correctly align the edge portion of the sheet bundle at a predetermined alignment position even in the case where each of the sheets is curled, a press portion 1J made of an elastic plate member is provided to press the downstream edge of the sheet bundle whose end portion has been allowed to be butted against the stopper 211 downward against the tray 4. On the other hand, in order to align the sheet position in the direction perpendicular to the feeding direction R of the sheet S, a not-shown alignment plate capable of shifting in the direction perpendicular to the feeding direction is provided to press the edge potion of the sheet S in the direction perpendicular to the paper surface in FIG. 11 to a not-shown reference plate.

In this sheet alignment apparatus, the above sheet alignment operation is performed for each sheet until the number of sheets to be stacked on the stacking tray 4 has reached a preset number of sheets (the unit of sheets to be post-processed). The sheet bundle that has been aligned in the sheet alignment apparatus is subjected to predetermined post-processing in the sheet post-processing apparatus and then discharged on a discharge tray 5 by the discharge roller E and a feeding roller 301*a* of a swing guide 301 provided in the sheet post-processing apparatus.

The number of sheets constituting a sheet bundle to be aligned in the sheet alignment apparatus varies depending on circumstances. It is possible to align (eliminate the curl) the downstream edge of the sheet with a comparatively low pressing force in the case where a small number of sheets are to be aligned; whereas a higher pressing force is required in the case where a small number of the sheets is to be aligned.

Setting for the press portion 1J can be made such that a high pressing force is always applied to a sheet bundle so as to cope with a large number of sheets. However, if so, the pressing force may become overload in the alignment operation of the alignment plate, preventing stable alignment operation (particularly, in the case where the number of sheets to be aligned is small, sheets may be bended in the feeding direction by the alignment plate, and sheet may be bounded when the pressing force of the alignment plate is released to cause malfunction in the alignment operation).

As a method that can solve the problem relating to a relationship between the number of the sheets to be aligned and pressing force of the press portion, the following prior arts have been known: one that changes the pressing force of the press portion according to the number (height) of sheets constituting a sheet bundle (Jpn. Pat. Appln. Laid-Open Publication No. 11-130338), one that changes the pressing force for holding a sheet bundle, which is given by a feeding roller that feeds a sheet to a predetermined alignment position, according to the stacking height of the sheet bundle (Jpn. Pat. Appln. Laid-Open Publication No. 2000-351522), and one that counts the number of sheets that have been stacked on the stacking tray and brings the sheet bundle close to a predetermined position (clinching surface) at the time point when a predetermined number of sheets are stacked so that a sheet bundle having a large thickness can be stapled without fail (Jpn. Pat. Appln. Laid-Open Publication No. 9-216764).

However, in the above configurations, it is necessary to add a special component such as a means for detecting the height of a sheet bundle or number of the staked sheets or a mechanism for changing the pressing force given by the press portion, which may prevent miniaturization and cost reduction.

SUMMARY OF THE INVENTION

The present invention has been made to solve the above problems, and an object thereof is to provide a sheet alignment apparatus capable of always performing a correct alignment operation irrespective of the number of sheets to be aligned without adding complicated components and a sheet post-processing apparatus provided with the sheet alignment apparatus.

To solve the above problem, according to the present invention, there is provided a sheet alignment apparatus comprising: a feeding section that sequentially feeds a sheet to a predetermined alignment position; a stopper against which the downstream side edge in the feeding direction of the sheet that has been fed by the feeding section is butted in order for the sheet to be stopped at the predetermined alignment position; a stacking tray on which the sheet that has been butted against the stopper is stacked; a support portion that supports the lower surface of the sheet that has been stacked on the stacking tray at the portion near the downstream side edge; a first press portion that presses the portion near the downstream side edge of a sheet bundle composed of the sheets that have been stacked on the stacking tray to a level higher than a first predetermined height against the support portion; and a second press portion that presses the portion near the downstream side edge of a sheet bundle composed of the sheets that have been stacked on the stacking tray to a level higher than a second predetermined height that is higher than the first predetermined height against the support portion.

According to the present invention, there is provided a sheet post-processing apparatus comprising: the sheet alignment apparatus having the above configuration; and a post-processing section that applies predetermined post-processing to a predetermined site near the downstream side edge of sheets that have been stacked at the predetermined alignment position by the sheet alignment apparatus, wherein the first press portion is situated closer to the post-processing section than the second press portion.

DETAILED DESCRIPTION OF THE PREFERRED EMBODIMENTS

Embodiments of the present invention will be described below with reference to the accompanying drawings.

First Embodiment

Figure 1:
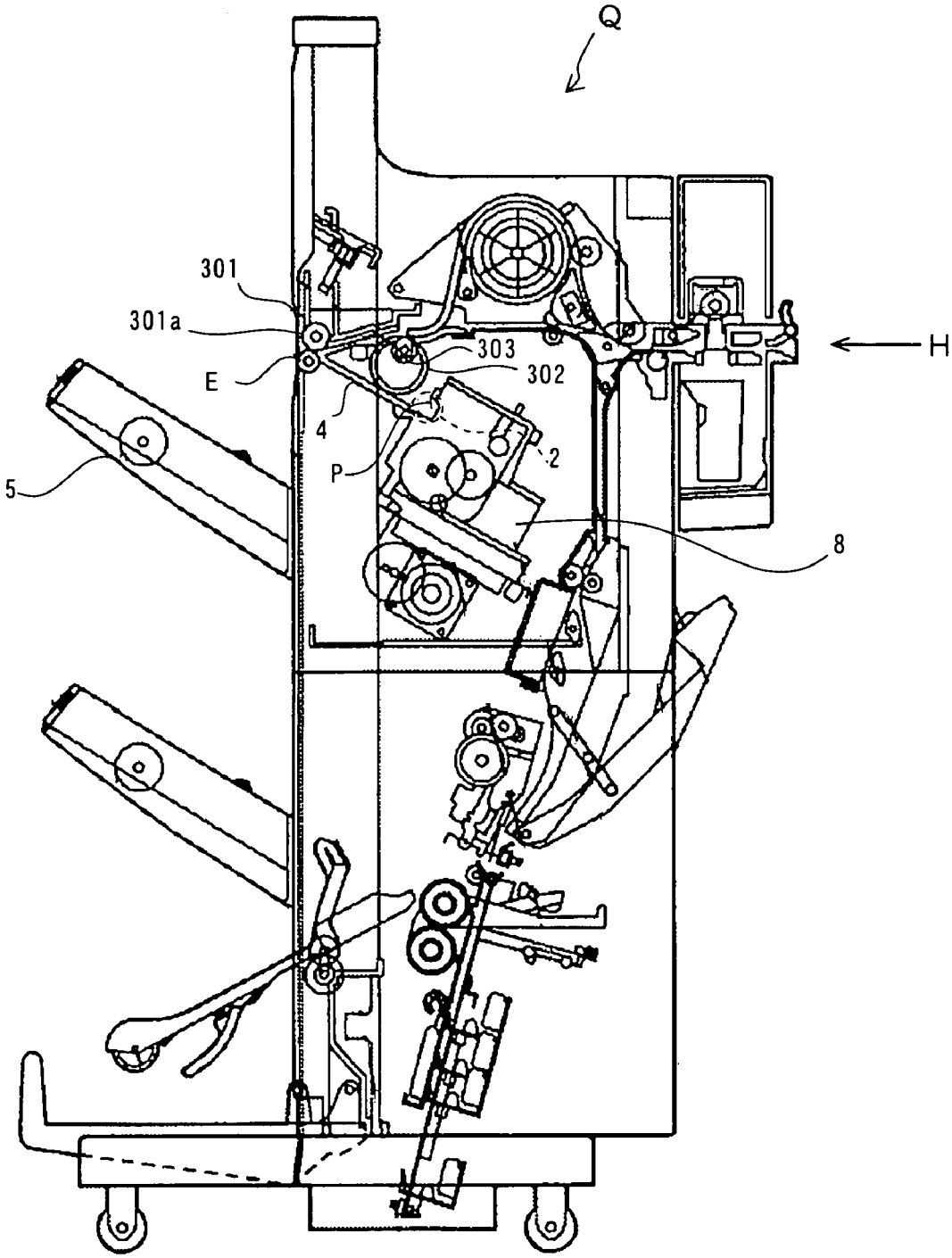
FIG. 1 is an entire configuration view for explaining a sheet alignment apparatus according to a first embodiment of the present invention and a sheet post-processing apparatus provided with the sheet alignment apparatus.

FIG. 1 is an entire configuration view for explaining a sheet alignment apparatus according to the first embodiment of the present invention and a sheet post-processing apparatus provided with the sheet alignment apparatus. The sheet alignment apparatus according to the present embodiment and the sheet post-processing apparatus provided with the sheet alignment apparatus differ from the abovementioned conventional apparatus in the configuration of the press portion that presses a sheet bundle downward at an alignment position. Hereinafter, components having the same functions as those that have been described above are indicated by the same reference numerals.

A sheet post-processing apparatus Q according to the first embodiment includes a feeding roller 303, a sheet discharge roller E, a stapler (post-processing section) 8, a swing guide 301, a sheet discharge tray 5, and a sheet alignment apparatus according to the first embodiment.

The sheet post-processing apparatus Q sequentially guides a sheet to be subjected to predetermined post-processing, which is supplied in the H direction, toward the stacking tray 4 using the feeding roller 303 and aligns the sheet in the sheet alignment apparatus. After that, the sheet post-processing apparatus Q staples an aligned sheet bundle and discharges the sheet bundle on a discharge tray 5 using a feeding roller 301*a* of a swing guide 301 capable of being brought into contact with the discharge roller E.

Details of the sheet alignment apparatus according to the present embodiment will next be described. The sheet alignment apparatus according to the first embodiment includes a knurled belt 302, a sheet discharge roller E, a stopper portion 2, a stacking tray 4, and a press portion P.

Figure 2:
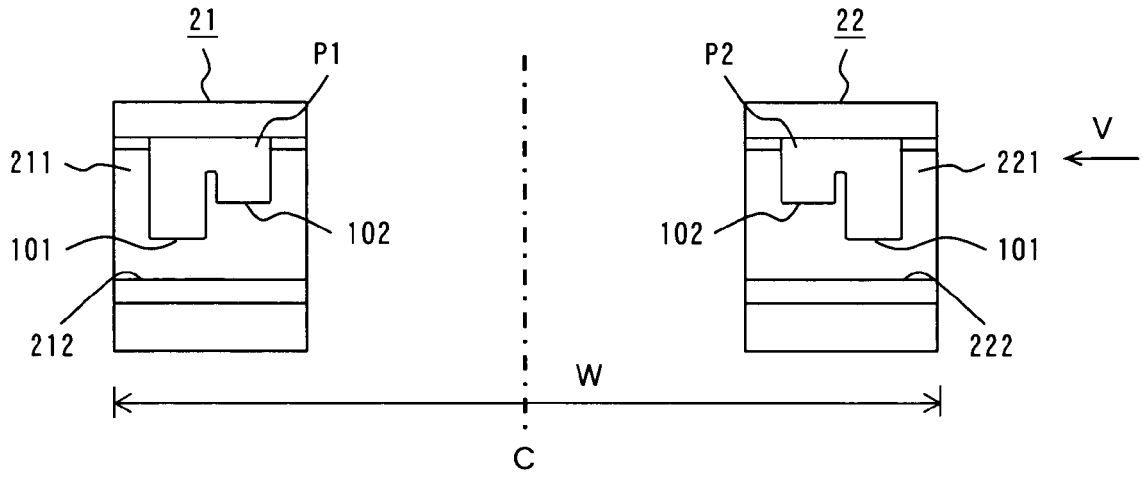
FIG. 2 is a stopper portion 2 and press portion P of the sheet alignment apparatus according to the first embodiment as viewed in the feeding direction of a sheet S, toward the stopper portion 2.
Figure 3:
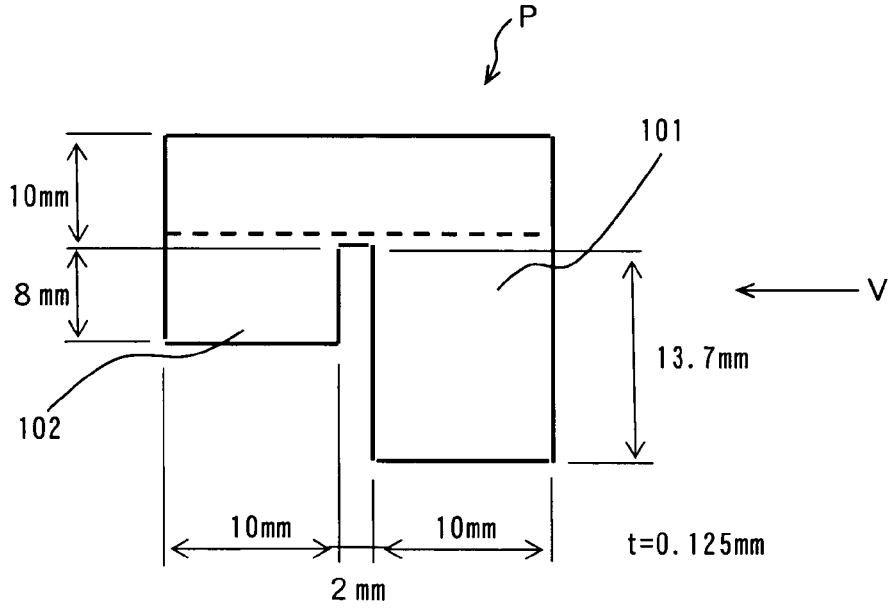
FIG. 3 is a view showing details of the press portion P.
Figure 4:
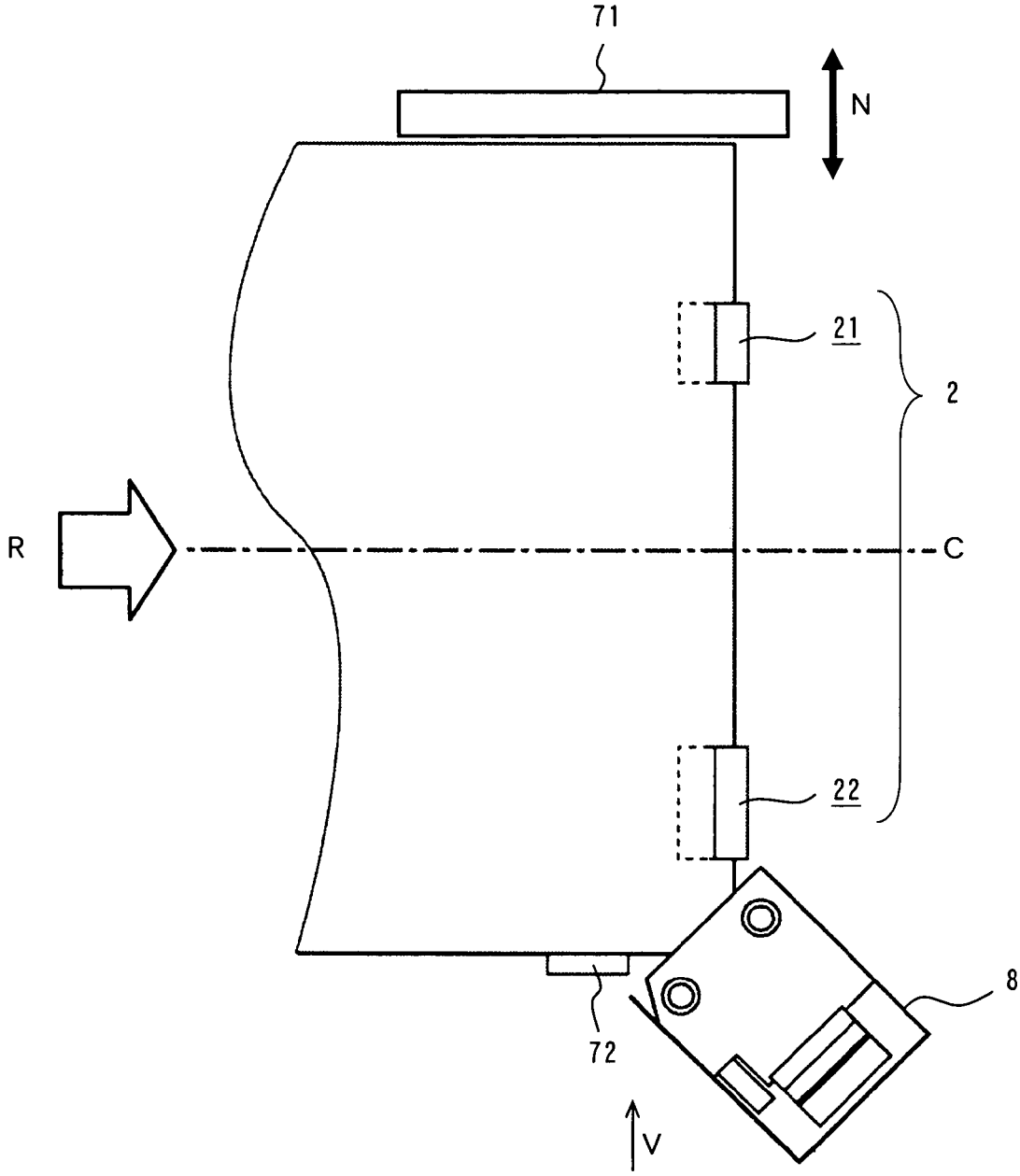
FIG. 4 is a view showing the stopper portion 2 and a stapler 8 as viewed from above.
Figure 11:
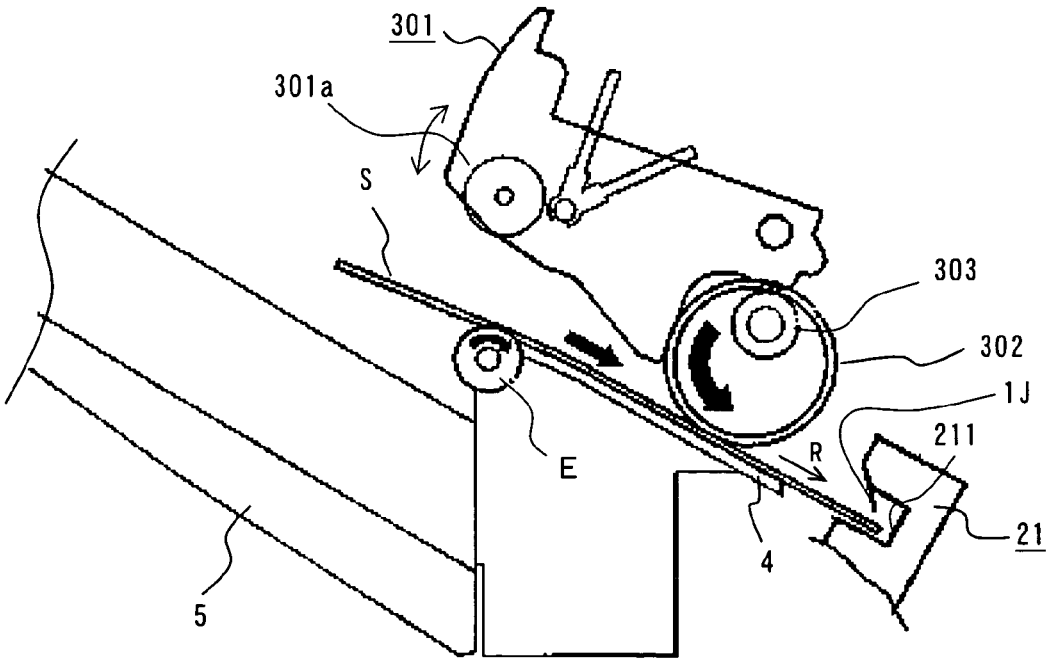
FIG. 11 is a vertical cross-sectional view showing a configuration around a sheet alignment apparatus in a conventional sheet post-processing apparatus.

FIG. 2 is the stopper portion 2 and press portion P of the sheet alignment apparatus according to the first embodiment as viewed in the feeding direction of a sheet S (in the direction of the arrow R in FIG. 11), toward the stopper portion 2, FIG. 3 is a view showing details of the press portion P (as viewed in the direction of the arrow A in FIG. 5), and FIG. 4 is a view showing the stopper portion 2 and a stapler 8 as viewed from above.

The knurled belt 302 and sheet discharge roller E (feeding section) feeds a sheet, which has been guided on the stacking tray 4 and is slipping down by its own weight on the stacking tray 4, toward a predetermined alignment position (sheet butting surfaces of stoppers 211 and 221 to be described later).

As shown in FIGS. 2 and 4, the stopper portion 2 is constituted by stopper portions 21 and 22, which are arranged in the direction substantially perpendicular to the sheet feeding direction R. The stopper portion 21 has a stopper 211 and a support portion 212. A sheet S, which has been fed by the feeding section, is stopped at a predetermined alignment position with the downstream edge thereof in the feeding direction (direction of the arrow R) butted against the stopper 211. The sheet is then stacked on the stacking tray 4 with the lower surface of the edge portion in the vicinity of the downstream side thereof supported by the support portion 212. The stopper portion 22 has a stopper 221 and support portion 222 having the same functions as those described above.

On the stacking tray 4, the sheets S that have been butted against the stoppers 211 and 221 are sequentially stacked.

One press portion P is constituted by a first press portion 101 and a second press portion 102, which are adjacently arranged in the direction substantially perpendicular to the direction R (direction of the arrow V in FIG. 2) that the feeding section feeds a sheet. The press portion P in the first embodiment is constituted by two press portions P1 and P2 (both having the same configurations as that of the press portion P) provided in the stopper portion 21 and stopper portion 22, respectively. That is, the press portions P1 and P2 are also arranged in the direction substantially perpendicular to the sheet feeding direction.

The first press portion 101 presses the downstream edge of sheets that have been stacked, on the stacking tray 4, to a level higher than a first predetermined height (for example, a position away from the support surface of the support portion by 4 mm in the normal line direction) against the support portion. The second press portion 102 presses the downstream edge of sheets that have been stacked, on the stacking tray 4, to a level higher than a second predetermined height (for example, a position away from the support surface of the support portion by 8 mm in the normal line direction) that is higher than the first predetermined height against the support portion. The press section P has a role of guiding a fed sheet to the stopper portion 2 as well as pressing the sheet against the support portion.

More specifically, each of the first and second press portions 101 and 102 is formed from a plate-like material made of an elastic member such as polyethylene terephthalate. The press portions 101 and 102 extend from predetermined positions that can sandwich a sheet S stacked on the stacking tray 4 between themselves and support portions 212 and 222 toward the sheet. In this example, the first and second press portions 101 and 102 are integrally formed from the plate-like material made of polyethylene terephthalate. The area from the upper edge portion to the dotted line shown in FIG. 3 in the above-formed press portion P is fixed to the stopper portion by adhesives or other fastening means. The first and second press portions 101 and 102 can independently be deformed in an elastic manner.

The first and second press portions 101 and 102 are disposed within the range between central position C and the edge of range W where the support portions 212 and 222 are arranged in the V direction which is substantially perpendicular to the sheet feeding direction R such that the first press portion 101 is situated on the edge side. That is, the first press portion 101 is situated closer to a processing position of the stapler 8 than the second press portion 102 (see FIG. 4). Further, in the first embodiment, two stopper portions are arranged in the V direction, thereby minimizing the area that the stopper portion covers on the portion in the vicinity of the downstream edge in the feeding direction of an aligned sheet bundle. As a result, it is possible to ensure an area large enough to perform post-processing without the need of moving the stopper portion from the aligned sheet bundle.

Figure 5:
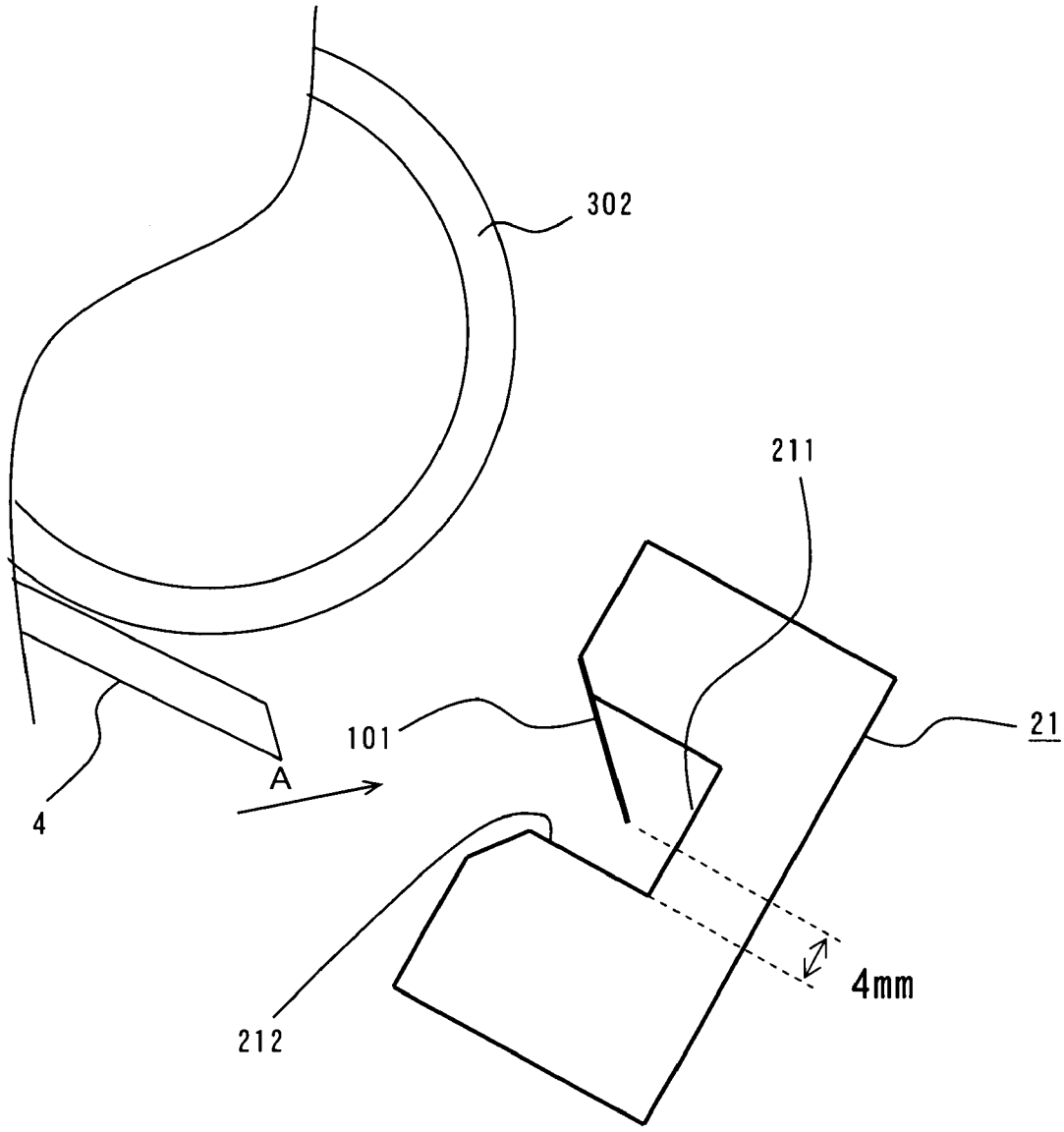
FIG. 5 is a view showing a press portion 101 of the stopper portion 21 and a stacking tray 4 as viewed in the direction along the arrow V of FIG. 2.
Figure 6:
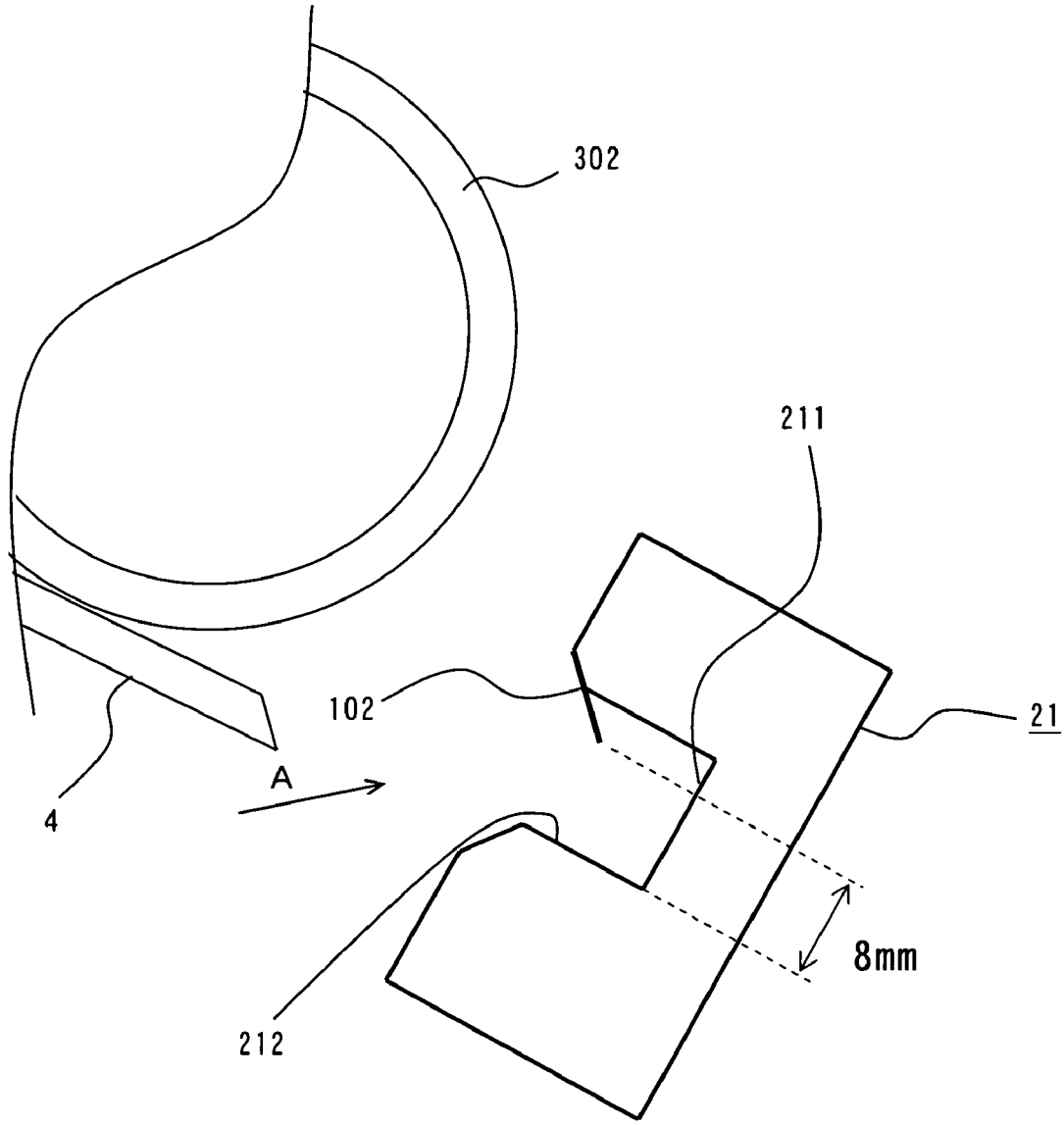
FIG. 6 is a view showing the press portion 102 of the stopper portion 21 and stacking tray 4 as viewed in the direction along the arrow V of FIG. 2.
Figure 7:
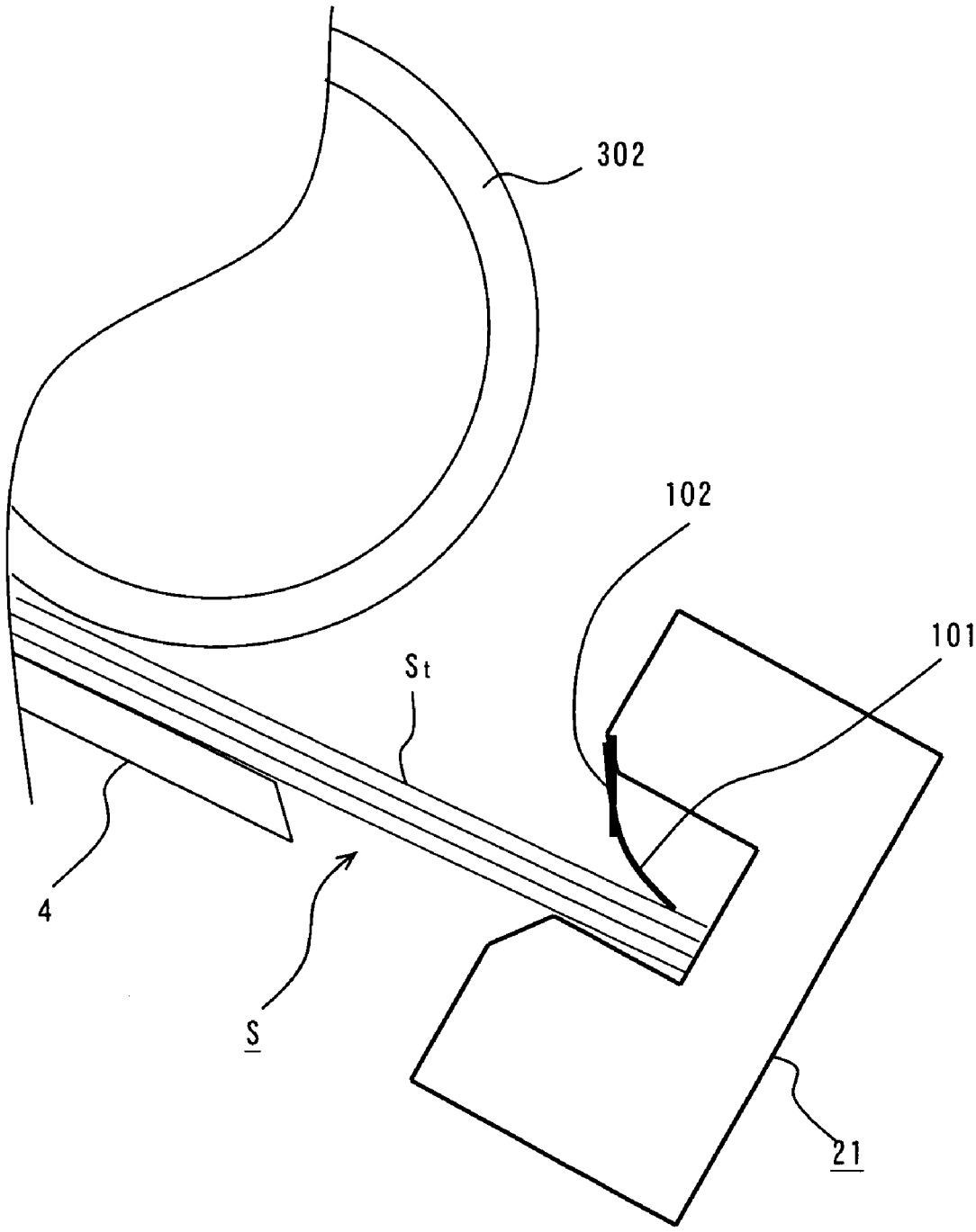
FIG. 7 is a view showing the press portion 101 of the stopper portion 21 and stacking tray 4 on which a small number of sheets are stacked as viewed in the direction along the arrow V of FIG. 2.
Figure 8:
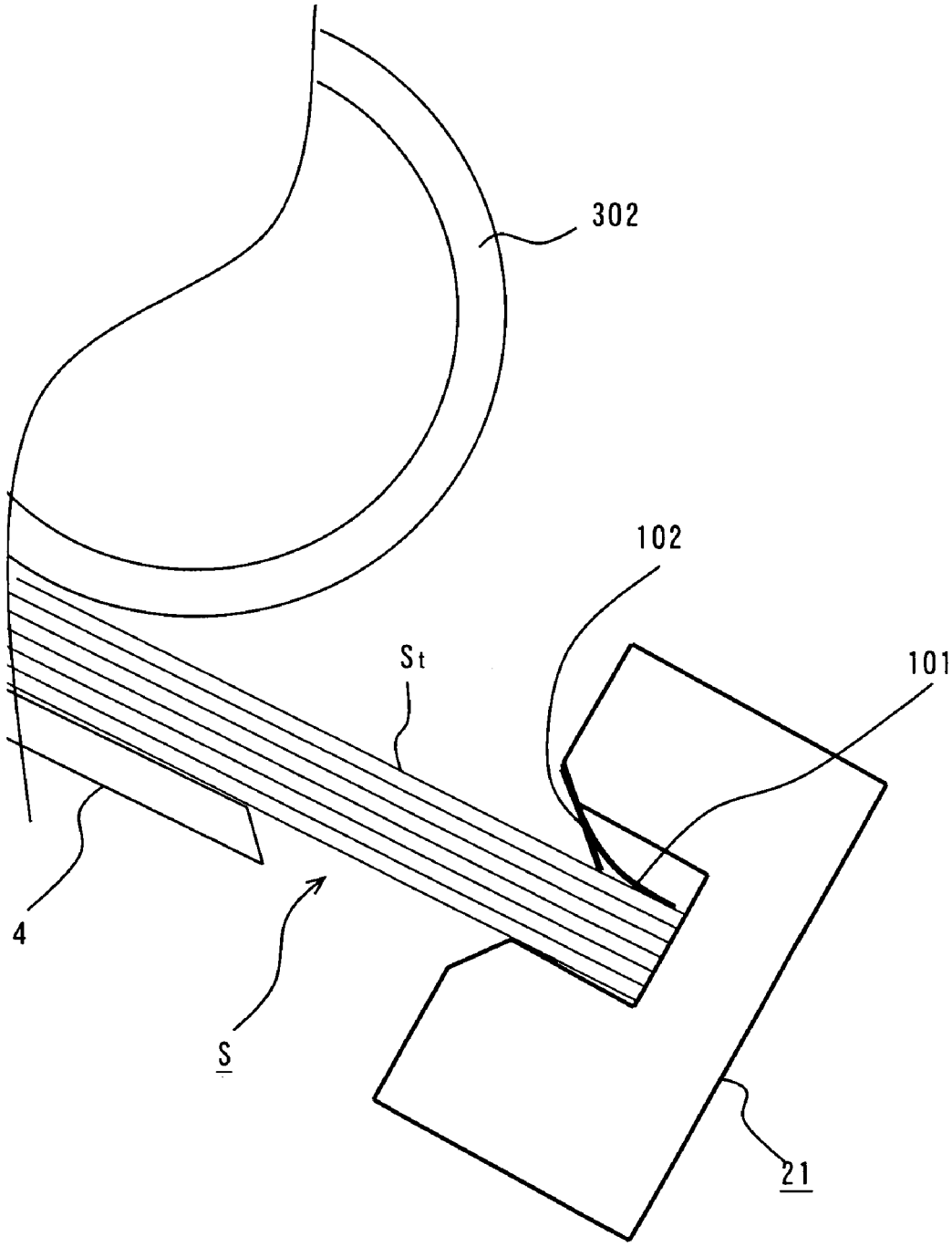
FIG. 8 is a view showing the press portion 102 of the stopper portion 21 and stacking tray 4 on which a large number of sheets are stacked as viewed in the direction along the arrow V of FIG. 2.

FIG. 5 is a View showing the press portion 101 of the stopper portion 21 and stacking tray 4 as viewed in the direction along the arrow V of FIG. 2, FIG. 6 is a view showing the press portion 102 of the stopper portion 21 and stacking tray 4 as viewed in the direction along the arrow V of FIG. 2, FIG. 7 is a view showing the press portion 101 of the stopper portion 21 and stacking tray 4 on which a small number of sheets are stacked as viewed in the direction along the arrow V of FIG. 2, and FIG. 8 is a view showing the press portion 102 of the stopper portion 21 and stacking tray 4 on which a large number of sheets are stacked as viewed in the direction along the arrow V of FIG. 2.

As shown in FIGS. 5 and 6, the length of the plate-like material of the first press portion 101 in the extending direction thereof is set such that the edge of the first press portion 101 on the side that faces a sheet surface contacts the uppermost sheet of stacked sheets when the sheets are stacked up to the first predetermined height (4 mm) on the stacking tray 4. Similarly, the length of the plate-like material of the second press portion 102 in the extending direction thereof is set such that the edge of the second press portion 102 on the side that faces a sheet surface contacts the uppermost sheet of stacked sheets when the sheets are stacked up to the second predetermined height (8 mm) on the stacking tray 4.

When a small number of sheets (for example, 30 to 50 sheets) are stacked on the stacking tray 4, only the first press portion 101 is used to press a sheet St which is the uppermost sheet of the sheet bundle against the support portion; on the other hand, when a large number of sheets (for example, 50 to 100 sheets) are stacked on the stacking tray 4, both the first and second press portions 101 and 102 are used to press a sheet St which is the uppermost sheet of the sheet bundle against the support portion.

That is, it is possible to press the sheet bundle composed of a small number of sheets with a moderate pressing force and it is possible to press the sheet bundle composed of a large number of sheets with a high pressing force. Thus, it is possible to press the sheet bundle with an adequate pressing force in accordance with the number of sheets, thereby ensuring stable alignment operation.

Further, the first press portion 101 is situated near the stapler, so that it is possible to perform the post-processing after completely removing the curl in the portion to be subjected to the post-processing without fail even if the number of sheets to be subjected to post-processing is small.

Further, the first and second press portions 101 and 102 are symmetrically disposed with respect to the central position C, thereby preventing a moment that tilts a sheet from being applied thereto when the sheet is brought into contact with the press portion.

The sheet bundle that has been stacked on the stacking tray 4 after being aligned at a predetermined alignment position by the sheet alignment apparatus having the above configuration is pressed by an alignment plate 71 that can move in the direction of the arrow N in FIG. 4 against a reference plate 72. The position of the sheet bundle in the direction substantially perpendicular to the sheet feeding direction is thus also aligned and, after that, staple processing is applied to a predetermined site in the vicinity of the downstream side edge of the sheet bundle by the stapler 8.

Second Embodiment

A second embodiment of the present invention will next be described.

The second embodiment is a modification of the first embodiment and differs from it in the shape of the stopper portion. In this embodiment, the same reference numerals as the first embodiment are given to the components which are common to the first embodiment, and the overlapped description is omitted.

Figure 9:
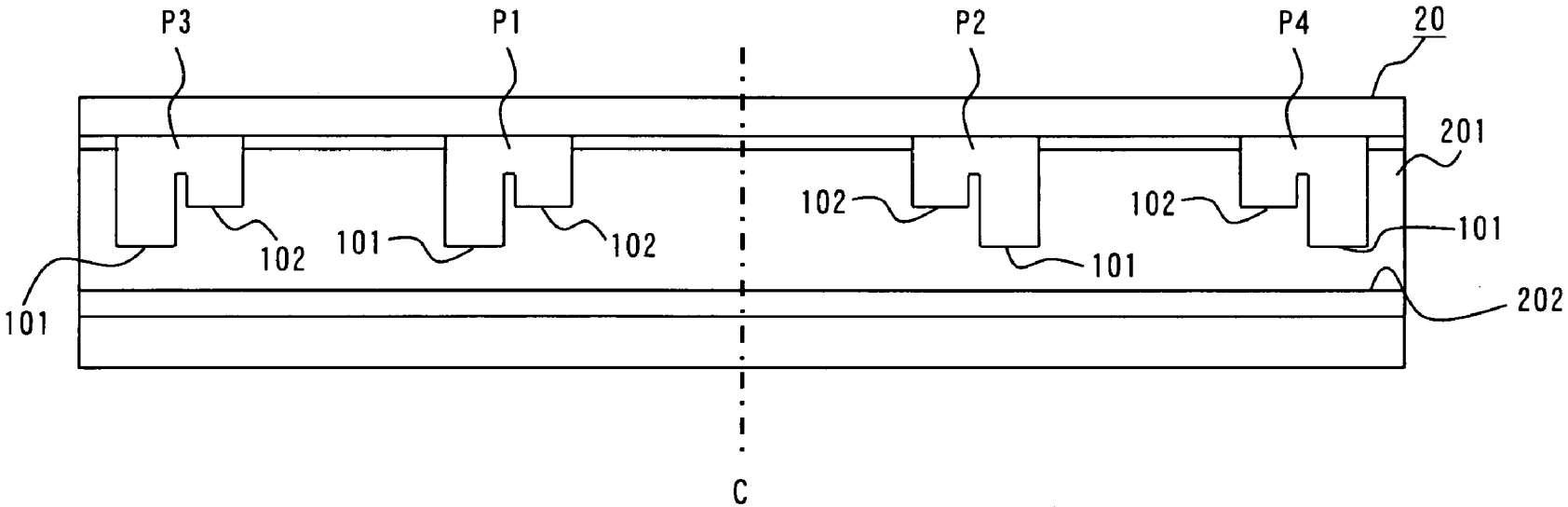
FIG. 9 is a stopper portion 20 and press portion of the sheet alignment apparatus according to a second embodiment as viewed in the feeding direction of a sheet S, toward the stopper portion 20.

FIG. 9 is a stopper portion 20 and press portion of the sheet alignment apparatus according to the second embodiment as viewed in the feeding direction of a sheet S (in the direction of the arrow R in FIG. 11), toward the stopper portion 20.

As shown in FIG. 9, the stopper portion 20 according to the second embodiment is not separated in the direction perpendicular to the sheet feeding direction R, but a plurality of press portions P1 to P4 are arranged in one stopper portion. By arranging a plurality of press portions as described above, it is possible to uniformly remove the curl, which is generated in the leading end (downstream side edge of the sheet in the direction that a sheet is fed to the stopper) of the sheet that has been butted against the stopper 210, in the direction perpendicular to the sheet feeding direction.

Third Embodiment

A third embodiment of the present invention will next be described.

The third embodiment is a modification of the first embodiment and differs from it in the shape of the stopper portion. In this embodiment, the same reference numerals as the first embodiment are given to the components which are common to the first embodiment, and the overlapped description is omitted.

Figure 10:
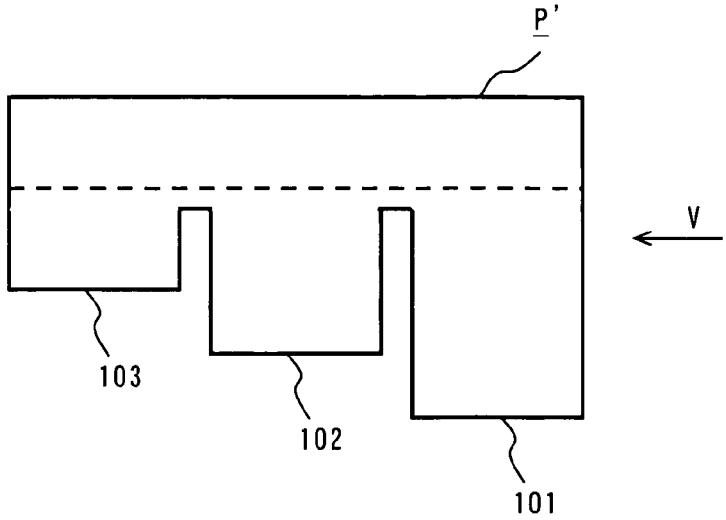
FIG. 10 is a view showing a configuration of a press portion P' in a third embodiment of the present invention.

FIG. 10 is a view showing a configuration of a press portion P' in the third embodiment. In the above embodiments, two height levels are set depending on the number of sheets in the press portion. Alternatively, however, three or more levels may be set.

As shown in FIG. 10, the press portion P' has a third press portion 103 in addition to the first and second press portions 101 and 102.

When a plurality of press portions corresponding to three height levels are provided for a sheet bundle as described above, the height at which the press portion start pressing the sheet bundle is minutely set. Therefore, it is possible to apply a pressing force more adequately to a sheet bundle composed of a small number of sheets, a large number of sheets, or an intermediate number of sheets.

Although in the above embodiments, the discharge roller E is used as the feeding section that feeds a sheet to the stopper, only the knurled belt 302 may serve as the feeding section.

Although in the above embodiments, a plate-like material made of an elastic member is adopted as the press portion, any press means may be used as long as it can apply a pressing force to a sheet bundle having a predetermined height.

Although in the above embodiments, the post-processing section that performs predetermined post-processing for a sheet bundle is the stapler, it may be a hole puncher that performs punching.

Although in the above embodiments, the first and second press portions are integrally formed, they may be separately formed.

Although in the above embodiments, the first and second press portions, each of which is formed from plate-like material made of an elastic member, have the same thickness, the thickness thereof may be made different according to the required pressing force.

As a sheet to be used in the above embodiments, any type of sheet may be used as long as it can be aligned in the above sheet alignment apparatus. The sheet can be an OHP film, as well as a copy paper.

While the present invention has been described in detail according to the specific embodiment, it will be apparent to those skilled in the art that variations and modifications are possible without deviating from the broad principles and spirit of the present invention.

As described above in detail, according to the present invention, it is possible to provide a sheet alignment apparatus capable of performing a correct alignment operation irrespective of the number of sheets to be aligned without adding complicated components and a sheet post-processing apparatus provided with the sheet alignment apparatus.

What is claimed is:

1. A sheet alignment apparatus comprising:

a feeding section that sequentially feeds a sheet to a predetermined alignment position;

a stopper against which the downstream side edge in the feeding direction of the sheet that is fed by the feeding section is butted in order for the sheet to be stopped at the predetermined alignment position;

a stacking tray on which the sheet that is butted against the stopper is stacked;

a support portion that supports the lower surface of the sheet that is stacked on the stacking tray at the downstream side edge;

a first press portion, having a first length and including a root fixed on the stopper, that elastically curves as a result of pressing an upper face of a sheet bundle composed of the sheets that are stacked on the stacking tray to a level higher than a first predetermined height against the support portion; and a second press portion, having a second length greater than the first length at a same position of the sheet feeding direction, and including a root fixed on the stopper, that elastically curves as a result of pressing an upper face of a sheet bundle composed of the sheets that are stacked on the stacking tray to a level higher than a second predetermined height that is higher than the first predetermined height against the support portion.

2. The sheet alignment apparatus according to claim 1, wherein the first and second press portions are formed as a part of a plate-like material made of an elastic member with a common root, extending from a predetermined position that sandwiches a sheet stacked on the stacking tray between itself and the support portion toward the sheet, the first length is a length of the plate-like material of the first press portion in the extending direction thereof and is set such that the edge of the first press portion on the side that faces a sheet surface contacts the uppermost sheet of stacked sheets when the sheets are stacked up to the first predetermined height on the stacking tray, and the second length is a length of the plate-like material of the second press portion in the extending direction thereof and is set such that the edge of the second press portion on the side that faces a sheet surface contacts the uppermost sheet of stacked sheets when the sheets are stacked up to the second predetermined height on the stacking tray.

3. The sheet alignment apparatus according to claim 2, wherein the first and second press portions are disposed within a range between a central position and an edge side where the support portion extends in the direction which is substantially perpendicular to the direction that the feeding section feeds a sheet such that the first press portion is situated on the edge side.

4. The sheet alignment apparatus according to claim 2, wherein the first and second press portions are adjacently arranged in the direction substantially perpendicular to the direction that the feeding section feeds a sheet and constitute a pair of press portions, and at least two pairs of the first and second press portions are arranged in the direction substantially perpendicular to the direction that the feeding section feeds a sheet.

5. The sheet alignment apparatus according to claim 2, wherein each of the first and second press portions is made of polyethylene terephthalate.

6. A sheet post-processing apparatus comprising:

the sheet alignment apparatus according to claim 2; and a post-processing section that applies predetermined post-processing to a predetermined site near the downstream side edge of sheets that are stacked at the predetermined alignment position by the sheet alignment apparatus, wherein the first press portion is situated closer to the post-processing section than the second press portion.

7. The sheet post-processing apparatus according to claim 6, wherein the post-processing section applies staple processing to a predetermined site near the downstream side edge of sheets that are stacked at the predetermined alignment position by the sheet alignment apparatus.

8. The sheet alignment apparatus according to claim 1, wherein the first and second press portions are integrally formed.

9. The sheet alignment apparatus according to claim 1, wherein at least a portion of the first and second press portions are lined in a horizontal direction.

10. A sheet alignment method comprising:

sequentially feeding a sheet to a predetermined alignment position;

stopping the sheet fed at the predetermined alignment position such that a downstream side edge in the feeding direction of the sheet is butted against a stopper;

stacking the sheet that is butted against the stopper in a stacking tray;

supporting the lower surface of the sheet that is stacked on the stacking tray at the downstream side edge in a support portion;

curving a first press portion elastically, the first press portion having a first length and including a root fixed on the stopper, as a result of pressing an upper face of a sheet bundle composed of the sheets that are stacked on the stacking tray to a level higher than a first predetermined height against the support portion; and curving a second press portion elastically, the second press portion having a second length greater than the first length at a same position of the sheet feeding direction, the second press portion including a root fixed on the stopper, as a result of pressing an upper face of a sheet bundle composed of the sheets that are stacked on the stacking tray to a level higher than a second predetermined height that is higher than the first predetermined height against the support portion.

11. The sheet alignment method according to clam 10, wherein the first and second press portion are formed as a part of a plate-like material made of an elastic member with a common root, extending from a predetermined position that sandwiches a sheet stacked on the stacking tray between itself and the support portion toward the sheet, the first length is a length of the plate-like material of the first press portion in the extending direction thereof and is set such that the edge of the first press portion on the side that faces a sheet surface contacts the uppermost sheet of stacked sheets when the sheets are stacked up to the first predetermined height on the stacking tray, and the second length is a length of the plate-like material of the second press portion in the extending direction thereof and is set such that the edge of the second press portion on the side that faces a sheet surface contacts the uppermost sheet of stacked sheets when the sheets are stacked up to the second predetermined height on the stacking tray.

12. The sheet alignment method according to claim 11, wherein the first and second press portions are disposed within a range between a central position and an edge said where the support portion extends in the direction which is substantially perpendicular to the direction that a sheet is fed such that the first press portion is situated on the edge said.

13. The sheet alignment method according to claim 11, wherein the first and second press portions are adjacently arranged in the direction substantially perpendicular to the direction that a sheet is fed and constitute a pair of press portions, and at least two pairs of the first and second press portions are arranged in the direction substantially perpendicular to the direction that a sheet is fed.

14. The sheet alignment method according to claim 11, wherein each of the first and second press portions is made of polyethylene terephthalate.

15. A sheet alignment method according to claim 11, further comprising:

applying, via a post-processing section, predetermined post-processing to a predetermined site near the downstream side edge of sheets that are stacked at the predetermined alignment position, wherein the first press portion is situated closer to the post-processing section than the second press portion.

16. The sheet alignment method according to claim 15, wherein applying via the post-processing section, staple processing to a predetermined site near the downstream side edge of sheets that are stacked at the predetermined alignment position.

17. The sheet alignment method according to claim 10, wherein the first and second press portions are integrally formed.

18. The sheet alignment method according to claim 10, wherein at least a portion of the first and second press portions are lined in a horizontal direction.

* * * * *